US009416611B2

(12) United States Patent
Heil et al.

(10) Patent No.: US 9,416,611 B2
(45) Date of Patent: Aug. 16, 2016

(54) METHOD FOR FORMING SLOTS IN A WELLBORE CASING

(75) Inventors: Matthias Heil, Dotlingen (DE); Frank Andriessen, Coevorden (NL); Mirjam Zwanenburg, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 760 days.

(21) Appl. No.: 13/699,455

(22) PCT Filed: May 24, 2011

(86) PCT No.: PCT/IB2011/052258

§ 371 (c)(1),
(2), (4) Date: Apr. 19, 2013

(87) PCT Pub. No.: WO2011/148315

PCT Pub. Date: Dec. 1, 2011

(65) Prior Publication Data

US 2015/0337612 A1 Nov. 26, 2015

Related U.S. Application Data

(60) Provisional application No. 61/396,213, filed on May 24, 2010.

(51) Int. Cl.
*E21B 29/00* (2006.01)
*E21B 33/14* (2006.01)
(Continued)

(52) U.S. Cl.
CPC ..... *E21B 29/002* (2013.01); *E21B 17/20* (2013.01); *E21B 29/005* (2013.01); *E21B 33/13* (2013.01); *E21B 33/134* (2013.01); *E21B 33/14* (2013.01); *E21B 43/114* (2013.01)

(58) Field of Classification Search
CPC ..... E21B 29/002; E21B 29/06; E21B 29/005; E21B 43/114
USPC ..... 166/298, 55.7
See application file for complete search history.

(56) References Cited

U.S. PATENT DOCUMENTS 3,081,282 A 3/1963 Mark
3,081,828 A * 3/1963 Quick ..... 175/67
(Continued)

FOREIGN PATENT DOCUMENTS

RU 32177 U1 9/2003
SU 590434 A1 1/1978
WO 2006053248 A2 5/2006

OTHER PUBLICATIONS

International Search Report for PCT Application Serial No. PCT/US2011/052258 dated Dec. 22, 2011.
(Continued)

*Primary Examiner* — Jennifer H Gay
*Assistant Examiner* — George Gray
(74) *Attorney, Agent, or Firm* — Michael L. Flynn; Tim Curington

(57) ABSTRACT

An embodiment of a method for forming slots in a wellbore casing, comprises providing at least one cutting tool, the cutting tool comprising at least a jetting assembly and an indexing assembly, disposing the cutting tool into the wellbore via a conveyance, stopping movement along the wellbore axis of the cutting tool, and forming slots in the casing by actuating the indexing assembly such that the jetting assembly forms slots in a predetermined pattern in the casing. In an embodiment, the method further comprises flowing a material into the slots formed in the casing to seal the wellbore.

17 Claims, 6 Drawing Sheets

(51) Int. Cl.

| | |
|---|---|
| ***E21B 33/134*** | (2006.01) |
| ***E21B 17/20*** | (2006.01) |
| ***E21B 33/13*** | (2006.01) |
| ***E21B 43/114*** | (2006.01) |

(56) References Cited

U.S. PATENT DOCUMENTS

| | | | | |
|---|---|---|---|---|
| 4,015,662 | A * | 4/1977 | Cochran | 166/104 |
| 4,346,761 | A | 8/1982 | Skinner et al. | |
| 5,445,220 | A | 8/1995 | Gurevich et al. | |
| 5,988,272 | A * | 11/1999 | Bruce | 166/55.6 |
| 6,564,868 | B1 * | 5/2003 | Ferguson et al. | 166/298 |
| 7,540,327 | B2 | 6/2009 | Billingham | |
| 2005/0263282 | A1 * | 12/2005 | Jeffrey et al. | 166/281 |
| 2007/0125577 | A1 | 6/2007 | Brunet | |
| 2007/0251692 | A1 | 11/2007 | Billingham et al. | |
| 2008/0156494 | A1 * | 7/2008 | Abadie | 166/298 |
| 2008/0179060 | A1 * | 7/2008 | Surjaatmadja et al. | 166/298 |
| 2011/0226474 | A1 * | 9/2011 | Hernandez | 166/298 |

OTHER PUBLICATIONS

First Examination Report for corresponding AU App No. 2011259761, Feb. 19, 2014, 3 pages.

Office Action issued in corresponding MX App No. MX/a/2012/013517 on Jan. 27, 2016, 4 pages.

Decision on Grant for corresponding RU App No. 2012155903, Jul. 7, 2015, 13 pages.

Office Action for corresponding RU App No. 2012155903, Mar. 12, 2015, 5 pages.

* cited by examiner

METHOD FOR FORMING SLOTS IN A WELLBORE CASING

BACKGROUND

The statements in this section merely provide background information related to the present disclosure and may not constitute prior art The present disclosure is related in general to wellsite and wellbore equipment such as oilfield surface equipment, downhole wellbore equipment and methods, and the like.

On occasion, a wellbore having casing or casings installed therein may need to be cemented, i.e., have cement flow into the area between the casing and the formation, for example, in order to plug and/or abandon a well. Cementing the area between the casing and formation should assist in plugging, killing, and/or abandoning the well.

In order to accomplish the cementing of the wellbore, it may be desirable to cut or form slots in the casing at a desired location while maintaining the structural integrity of the casing. After the slots are cut or formed in the casing, cement may be flowed into the slots and into the area between the casing and the formation to assist in the plugging and/or abandoning of the well.

It remains desirable to provide improvements in the efficiency, flexibility, reliability, and maintainability of wellsite surface and downhole equipment.

SUMMARY

An embodiment of a method for forming slots in a wellbore casing, comprises providing at least one cutting tool, the cutting tool comprising at least a jetting assembly and an indexing assembly, disposing the cutting tool into the wellbore via a conveyance, stopping movement along the wellbore axis of the cutting tool, and forming slots in the casing by actuating the indexing assembly such that the jetting assembly forms slots in a predetermined pattern in the casing. In an embodiment, the method further comprises flowing a material into the slots formed in the casing to seal the wellbore. The material may comprise a cement material. The method may further comprise killing the wellbore by flowing the material into the casing and at least an annulus disposed around the casing. In an embodiment, stopping movement comprises forming a solid base in the wellbore prior to disposing the jetting assembly into the wellbore and engaging the indexing assembly with the solid base. The solid base may comprise at least one of a bridge plug, a sand plug, a cement plug, and combinations thereof. In an embodiment, forming slots comprises forming slots in the casing without completely severing the casing into distinct portions thereof.

In an embodiment, forming slots comprises causing rotation of the jetting tool via reciprocating actuation of the indexing assembly, providing may comprise providing an indexing assembly comprising an outer shell and an inner mandrel disposed interior of the outer shell, the outer shell having a pin that engages with a helical groove formed in the outer surface of the mandrel, the indexing assembly further comprising a spring-biased bushing in the outer shell for urging the shell in an upward position, and causing rotation may comprise applying an axial force to the conveyance and compressing the spring and thereby allowing the outer shell to move downwardly while the mandrel remains substantially stationary, the pin engaging with the groove and rotating the jetting assembly and indexing assembly during movement thereof. In an embodiment, providing comprises providing surface equipment having a supply of jetting fluid in fluid communication with the cutting tool. In an embodiment, disposing comprises disposing the cutting tool into the wellbore via coiled tubing. In an embodiment, forming comprises forming slots in the casing that are substantially perpendicular to the wellbore axis of the cutting tool. In an embodiment, forming comprises forming slots in multiple concentric casings. In an embodiment, providing comprises providing a cutting tool with a jetting assemblies assembly comprising first and second nozzles and wherein forming comprises forming slots with the first nozzles, deactivating the first nozzles, activating the second nozzles and forming slots with the second nozzles.

An embodiment of a system for forming slots in a cased wellbore, comprises at least one cutting tool, the cutting tool comprising at least a jetting assembly and an indexing assembly, a conveyance for disposing the cutting tool in the wellbore, and surface equipment in fluid communication with the at least one cutting tool via the conveyance, the cutting tool configured to form a plurality of distinct slots in a predetermined pattern in the casing of the wellbore when actuated. In an embodiment, the conveyance comprises coiled tubing. In an embodiment, the surface equipment comprises jetting fluid equipment.

In an embodiment, the indexing assembly comprises an outer shell and an inner mandrel disposed interior of the outer shell, the outer shell having a pin that engages with a helical groove formed in the outer surface of the mandrel, the indexing assembly further comprising a spring-biased bushing in the outer shell for urging the shell in an upward position, wherein an application of an axial force to the conveyance compresses the spring, allowing the outer shell to move downwardly while the mandrel remains substantially stationary, the pin engaging with the groove and rotating the jetting assembly and indexing assembly during movement thereof. The cutting tool may further comprise a base index assembly for engaging with a solid base within the wellbore and further comprise a bearing for allowing rotation of the jetting assembly and indexing assemblies. In an embodiment, the at least one cutting tool comprises at least a pair of nozzle bodies for forming the slots, the tool further comprising at least one centralizer disposed between the nozzle bodies, wherein the at least a pair of nozzle bodies are configured to be selectively deactivated.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1A:
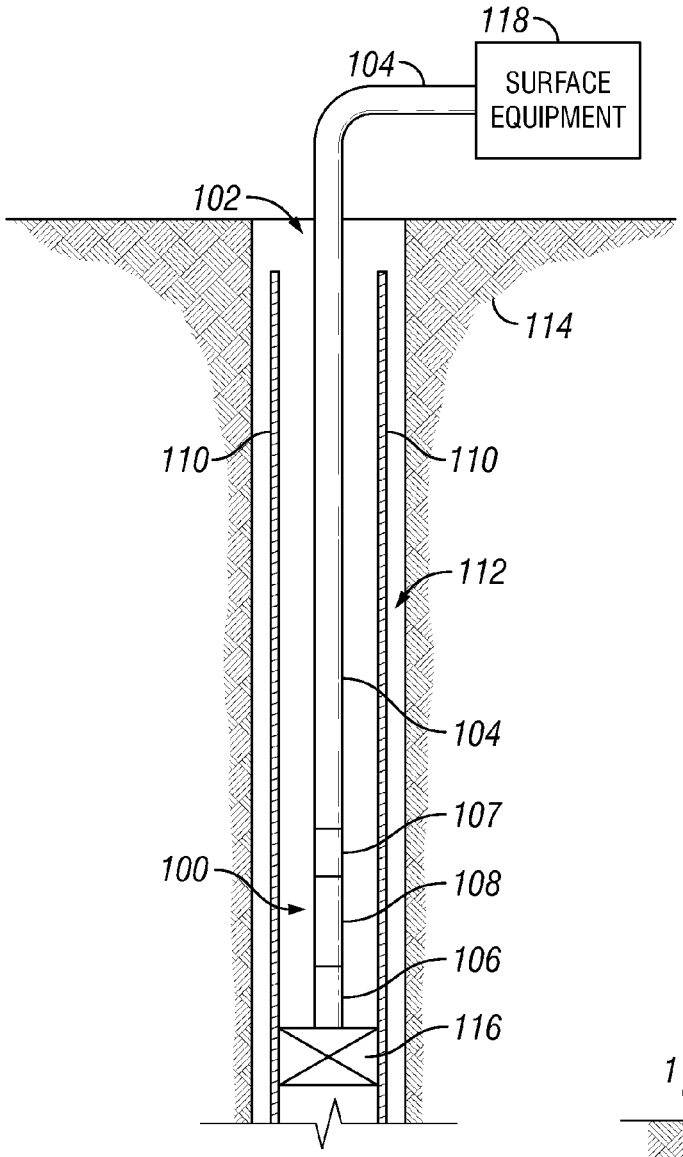
FIG. 1A is a schematic view of an embodiment of a cutting tool deployed in a wellbore.
Figure 1B:
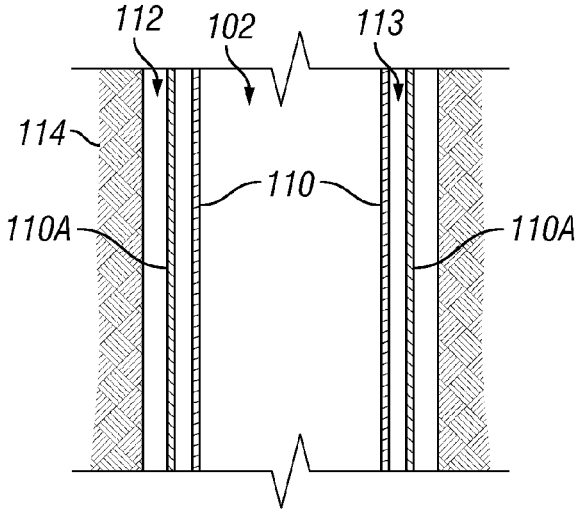
FIG. 1B is a schematic view of an embodiment of multiple concentric casings.

Referring now to FIG. 1A, a schematic view of cutting tool or gun is indicated generally at 100. The tool 100 is deployed into a wellbore 102 on a conveyance 104, such as coiled tubing or the like. The tool 100 comprises an upper indexing assembly 107, a jetting assembly 108, and a lower or base indexing assembly 106, discussed in more detail below. A casing 110 is deployed in the wellbore 102 and defines an area or annulus 112 between the casing 110 and the wellbore formation 114. The casing 110 may comprise a single casing, such as that shown in FIG. 1A, or multiple casings, such as multiple concentric casings comprising a casing 110 and at least one additional concentric casing 110*a*, such as that shown in FIG. 1B. In the case of multiple concentric casings, there may be concentric areas formed between the casings, such as the area 113 defined by casings 110 and 110*a* shown in FIG. 1*a*, and the annulus 112 formed between the casing 110*a* and the wellbore formation, such as the wellbore formation 114, as will be appreciated by those skilled in the art.

The conveyance or coiled tubing 104 is in fluid communication with suitable surface equipment 118, such as high pressure fluid pumps, a source of abrasive fluid and/or cement, or the like, as will be appreciated by those skilled in the art. The tool 100 is suitably deployed in the wellbore 102 adjacent a solid base 116, such as, but not limited to, a bridge plug, a sand plug, a cement plug, or any suitable solid base 116 for actuating the indexing assembly 106, discussed in more detail below. The solid base 116 is preferably formed prior to introducing the tool 100 into the wellbore 102.

Figure 2A:
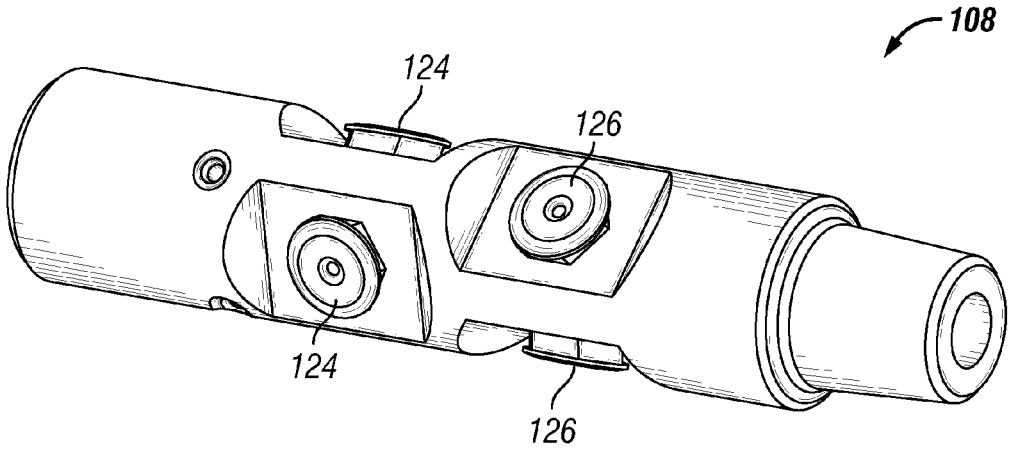
FIGS. 2*a* and 2*b* are schematic perspective views, respectively, of an embodiment of a cutting tool.
Figure 2B:
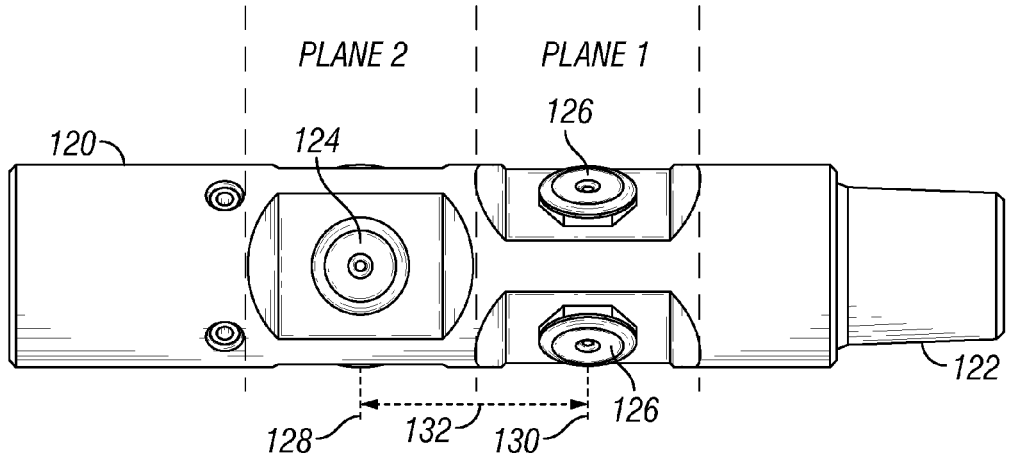

Referring now to FIGS. 2*a* and 2*b*, the jetting assembly 108 of the tool is shown having an upper portion 120 for attachment to the conveyance or coiled tubing 104 or the upper indexing assembly 107 and a lower portion 122 for attachment to the lower or base indexing assembly 106. The jetting assembly 108 comprises an upper set of jets 124 and a lower set of jets 126. In a non-limiting example, the upper set of jets 124 comprise three jets 124 arranged substantially equidistant about the circumference of the jetting assembly 108 (i.e. spaced about 120° apart along the circumference of the jetting assembly 108) and the lower set of jets 126 comprise three jets 126 arranged equidistant about the circumference of the jetting assembly 108 (i.e. about 120° along the circumference of the jetting assembly 108). The set of jets 124 and the set of jets 126 may each be located at substantially the same axial distance along the assembly 108 between the upper portion 120 and the lower portion 122. The jets 124 and the jets 126 are spaced apart at about 60° along the circumference of the jetting assembly 108 and the centerline 128 of the jets 124 is spaced apart from the centerline 130 of the jets 126 by a predetermined distance, indicated by an arrow 132. In a non-limiting example, the predetermined distance 132 may be about 2 inches or about 5 centimeters.

In an embodiment, best seen in FIGS. 4A through 5C, a jetting assembly or tool 400 is disclosed. The tool 400 comprises an upper indexing assembly 407, a jetting assembly 408, and a lower or base indexing assembly 406. The jetting assembly 408 comprises an upper nozzle body 424 and a lower nozzle body 426 spaced apart along the assembly 408 and having at least one centralizer 428 (four illustrated) disposed between the nozzle bodies 424 and 426 along the jetting assembly 408. The nozzle bodies 424 and 426 define a plurality of nozzles 425 therein and in fluid communication with a central bore 430 defined along the jetting tool 400. The centralizers 428 comprise a centralizer body 432 having at least one fin 434 extending therefrom. The fin or fins 434 of the centralizers 428 function to maintain radial alignment of the tool 400 and jetting assembly 408 within the borehole and thus provide a minimum radial spacing between the casing, such as the casing 110 and the nozzles 425, as the jetting assembly and conveyance are moved to the desired location within the wellbore 102 and/or the wellbore formation 114.

In the jetting tool 400, the nozzle bodies 424 and 426 define four nozzles 425 spaced apart at about 90 degrees along the circumference of the nozzle body 424 or 426. More or fewer nozzles 425 may be defined by the nozzle bodies 424 or 426. The nozzles 425 are spaced apart by a predetermined distance, as indicated by an arrow 427. The distance 427 defined by the nozzles 425 of the nozzle body 424 may be different than the distance 427 defined by the nozzles 425 of the nozzle body 426. The nozzles 425 may be removable inserts formed as part of the jetting assembly 408 to enable different sized nozzles 425 to be placed as part of the nozzle bodies 424 or 426 and/or to enable maintenance and/or replacement of the nozzles 425, as will be appreciated by those skilled in the art.

The upper indexing assembly 407 comprises an outer hollow shell or housing 436 slidably disposed about an inner mandrel 438. The inner mandrel 438 has a groove 440 formed in an exterior surface thereof. The groove 440 extends in a helical or spiral direction in an axial direction along the exterior surface of the mandrel 438. A pin or key 441 extends from an interior surface of the housing 436 of the upper indexing assembly 407 and engages with the surface defined by groove 440 of the mandrel 438. More than one cooperating groove 440 and pin 441 may be formed as part of housing 436 and mandrel 438 of the upper indexing assembly 407 such as, but not limited to, a groove 440 and a pin 441 formed on opposing sides of the housing 436 and the mandrel 438. The mandrel 438 extends into and defines part of the central bore 430 of the jetting assembly 408 and the lower indexing assembly 406. A bushing 442 is fixedly disposed in the housing 436 downstream of the pin 441 and is biased by a compression spring 444 or similar biasing device. The spring 444 is disposed between the bushing 442 and the axially movable portion of the housing 436, best seen in FIGS. 4A and 5A.

A bearing 456 or similar device is disposed on the mandrel 438 adjacent the lower or base indexing assembly 406 to allow for rotation of the inner mandrel 438, indexing assembly 407, jetting assembly 408 and base indexing assembly 406. The bearing 456 may be formed as part of a foot assembly 458 and disposed between an upper foot portion 452 and a lower foot portion 450.

In operation, the tool 100 or 400 is disposed in the wellbore and the base indexing assembly 406 is axially moved in the wellbore 102 and disposed against or engaged with the solid base 116, wherein vertical or axial movement of the tool 100 or 400 is prevented. The application of additional downward, axial, or downhole force to the tool 100 and conveyance 104, such as by surface equipment 118 or the like, compresses the spring 444 and allows movement of the housing 436 within the indexing assembly 106. The movement of the housing 436 allows the pin 436 to travel along the groove 440, applying a force to and thereby rotating the mandrel 438 and thus rotating the indexing assembly 407, jetting assembly 408 and base indexing assembly 406 about the bearing 446 of the base assembly 406, while the indexing assembly 407, jetting assembly 408 and base indexing assembly 406 remain axially stationary, i.e. do not move axially within the wellbore 102. Those skilled in the art will appreciate that similar methods or devices for converting a reciprocating axial movement or translation into rotational movement or translation may be utilized to rotate the indexing assembly 407, jetting assembly 408 and base indexing assembly 406.

Figure 3:
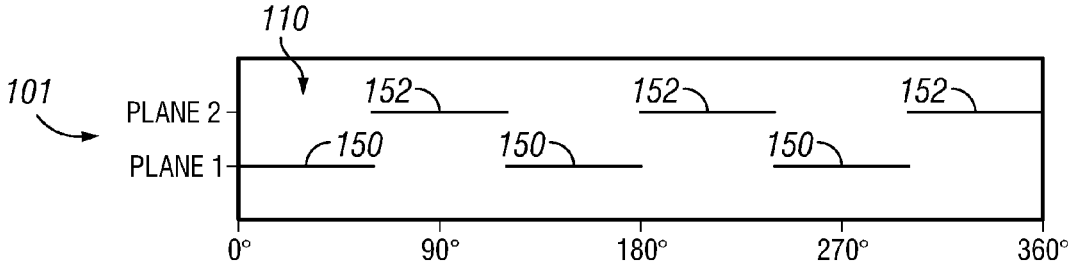
FIG. 3 is a schematic view of slots formed in a casing with an embodiment of a cutting tool.
Figure 4A:
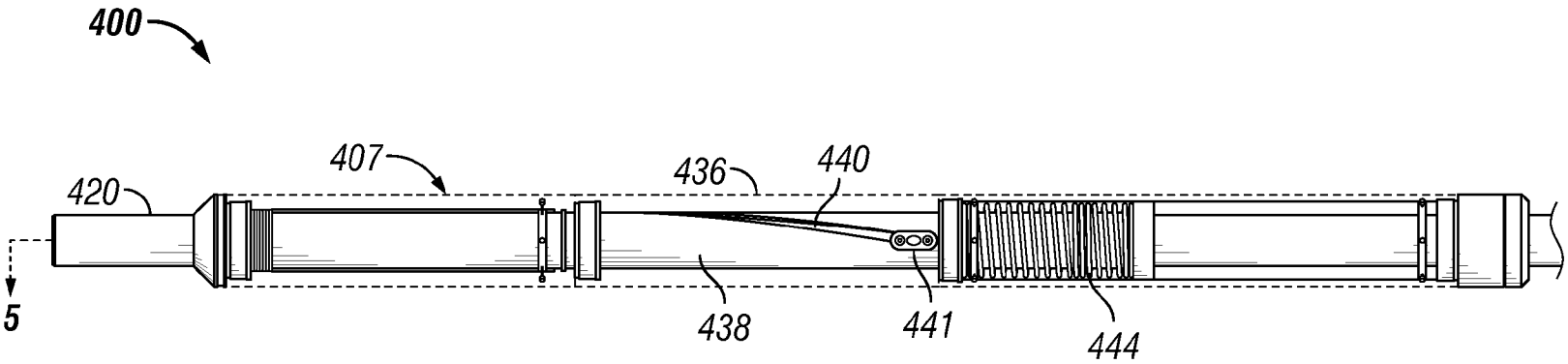
FIGS. 4A-4C are schematic side views, respectively, of an embodiment of a cutting tool.
Figure 5A:
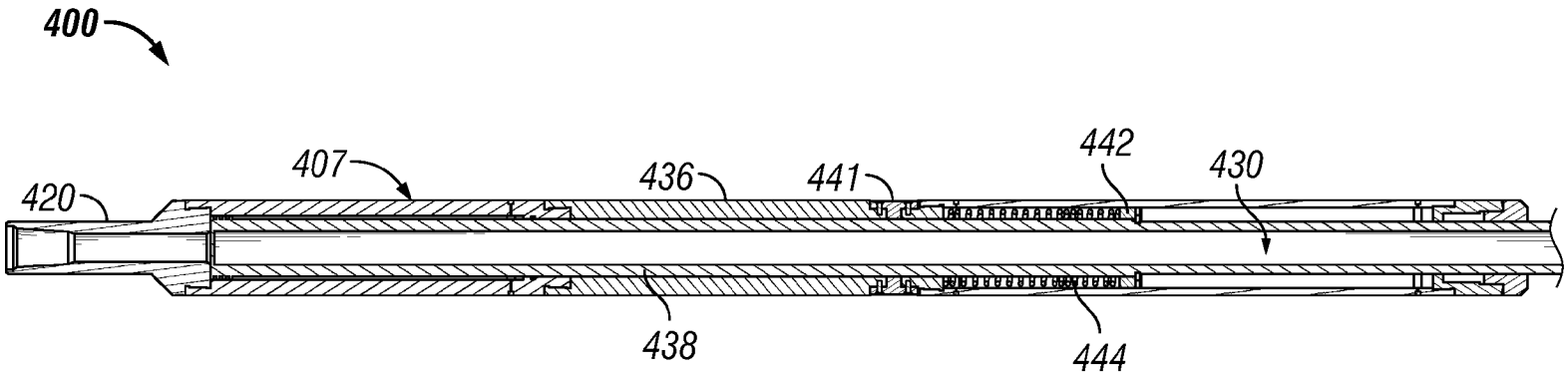
FIGS. 5A-5C are cross-sectional views, respectively, taken along line 5-5 in FIGS. 4*a*-4*d*.
Figure 4B:
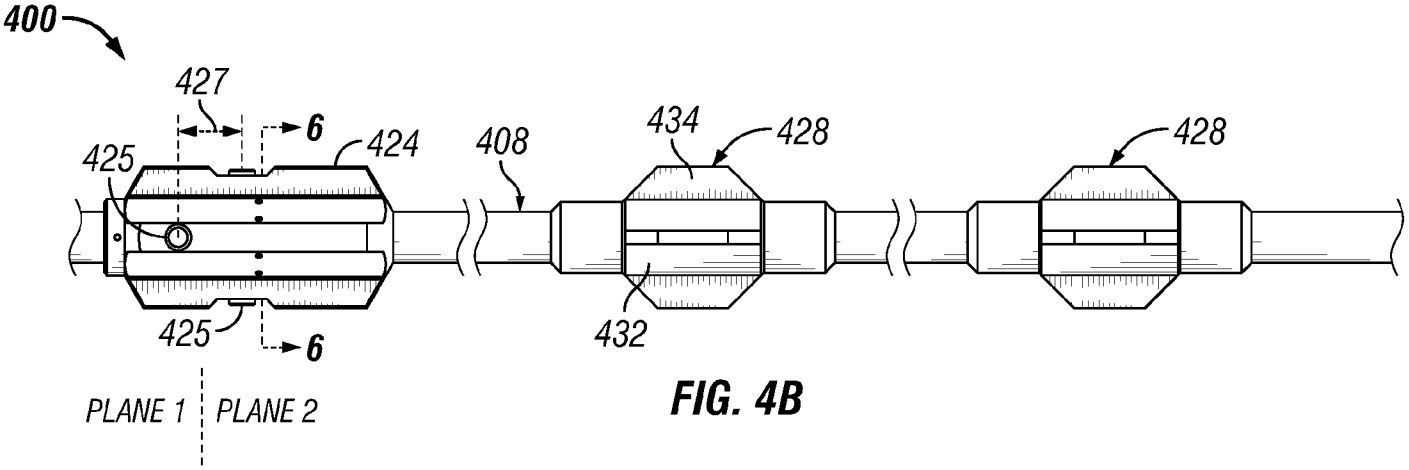
Figure 5B:
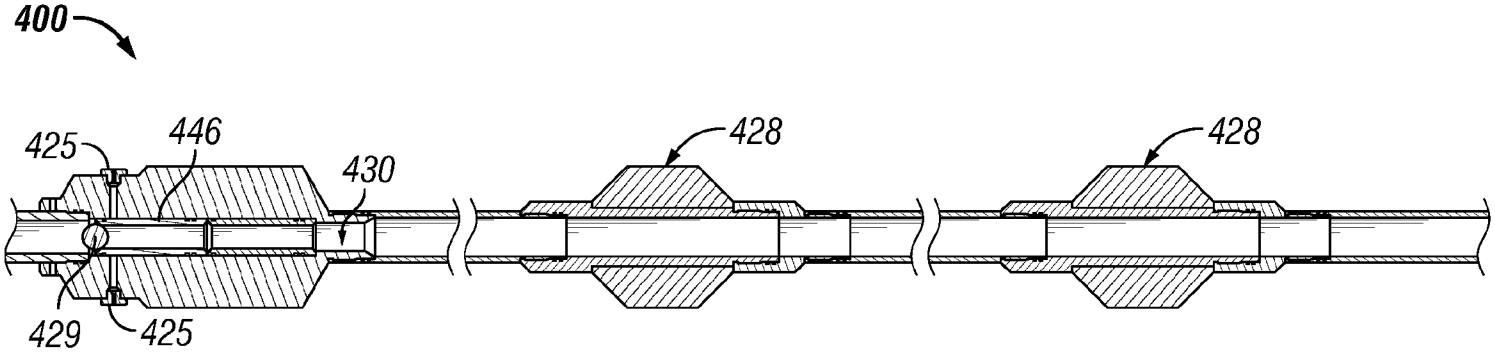
Figure 4C:
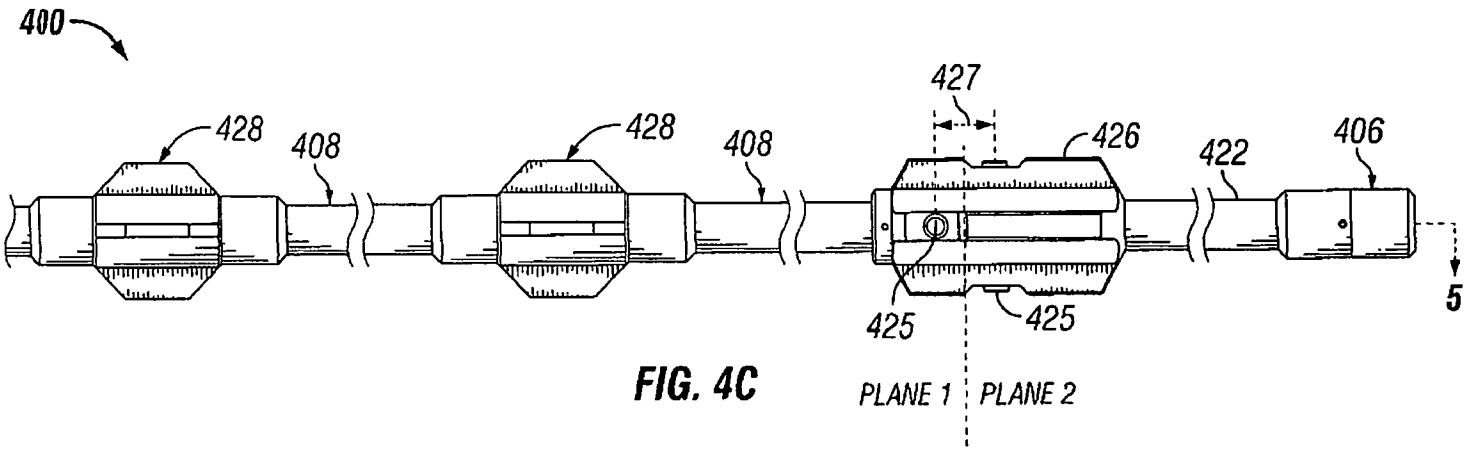
Figure 5C:
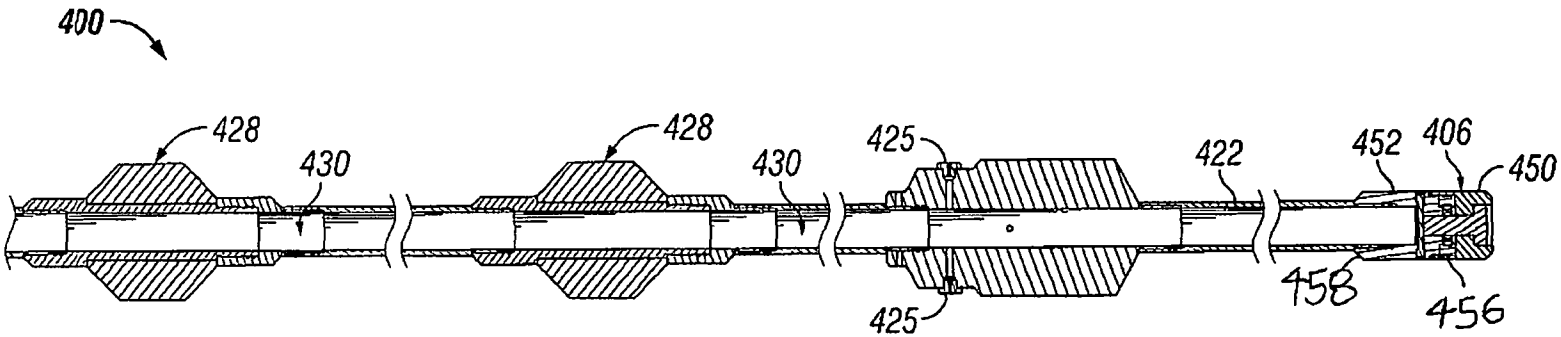

In order to form a slot or slots in the casing or casings 110 with the tool 100, abrasive or jetting fluid is flowed from the surface equipment 118 through the conveyance 104 and out the jets 124 and 126 of the jetting assembly 108. Force is applied to the tool 100 and conveyance 104 to rotate the jetting assembly 108. The abrasive fluid flows from the jets 124 and 126 and will form slots 150 and 152 in the casing 110 as the jetting assembly 108 is rotated by the indexing assemblies 106 and 107, as shown in FIG. 3, while the while the indexing assemblies 106 and 107 and jetting assembly 108 remain axially stationary.

In order to form a slot or slots in the casing or casings 110 with the tool 400, abrasive or jetting fluid is flowed from the surface equipment 118 through the conveyance 104 and out the nozzles 425 of the jetting assembly 408. An axial force is applied, such as intermittently or the like, to the tool 400 and conveyance 104 to rotate the jetting assembly 408. The abrasive fluid flows from the nozzles 425 and will form slots 160 and 162 in the casing 110 as the jetting assembly 408 is rotated by the indexing assemblies 406 and 407, as shown in FIG. 7, while the indexing assemblies 406 and 407 and the jetting assembly 408 remain axially stationary.

Figure 6:
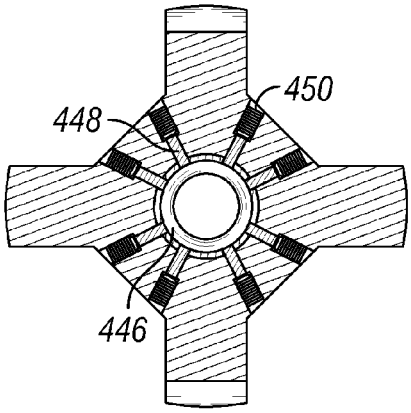
FIG. 6 is a cross-sectional view taken along line 5-5 in FIG. 4B.

In an embodiment of the tool 400, the upper nozzle body 424 may be inactive and the lower nozzle body 426 may be active. In such an embodiment, the nozzles 425 of the nozzle body 424 are blocked by a sleeve 446 disposed in the nozzle body 424 and thus are not in fluid communication with the central bore or passage 430. The sleeve 446 is held in place with a number of shear pins 450 and set screws 448, best seen in FIG. 6. With the sleeve 446 blocking the nozzles 425 of the nozzle body 424, fluid flows only out of the nozzles 425 of the nozzle body 426. To activate the upper nozzle body 424 and deactivate the lower nozzle body 426, a ball 429 may be dropped into the conveyance 104 and the tool 400 from the surface. The ball 429 engages with a seat portion of the sleeve 446, blocking fluid flow through the central bore 430 and allowing pressure to build up on the upstream side of the ball 429 and nozzle body 424. When a predetermined pressure is reached, the shear pins 450 fail or shear, which allows the sleeve 446 to move downwardly in the nozzle body 424 to expose the nozzles 425 of the nozzle body 424 to the central bore 430. The sleeve 446 may engage with a raised shoulder within the nozzle body 424 to prevent further downward movement of the sleeve 446 after the pins 450 have been sheared. A jetting operation may now be carried out through the nozzles 425 of the nozzle body 424 utilizing the indexing assemblies 406 and 407 as detailed hereinabove and further flow of jetting fluid through the central bore 430 is prevented by the presence of the ball 429.

Those skilled in the art will appreciate that the amount of axial and rotational movement of the tools 100 or 400 and thus the size of the slots 150 and 152 or 160 and 162 formed are based on the length and orientation of the groove 440 formed in the inner mandrel and thus may be varied depending on the requirements of the casing or casings 110. Thus, if the groove 440 has a short axial length, the corresponding slots 150, 152, 160, or 162, will be correspondingly short in length and may therefore comprise individual apertures rather than elongated slots as shown in FIGS. 3 and 7, discussed in more detail below.

Figure 7:
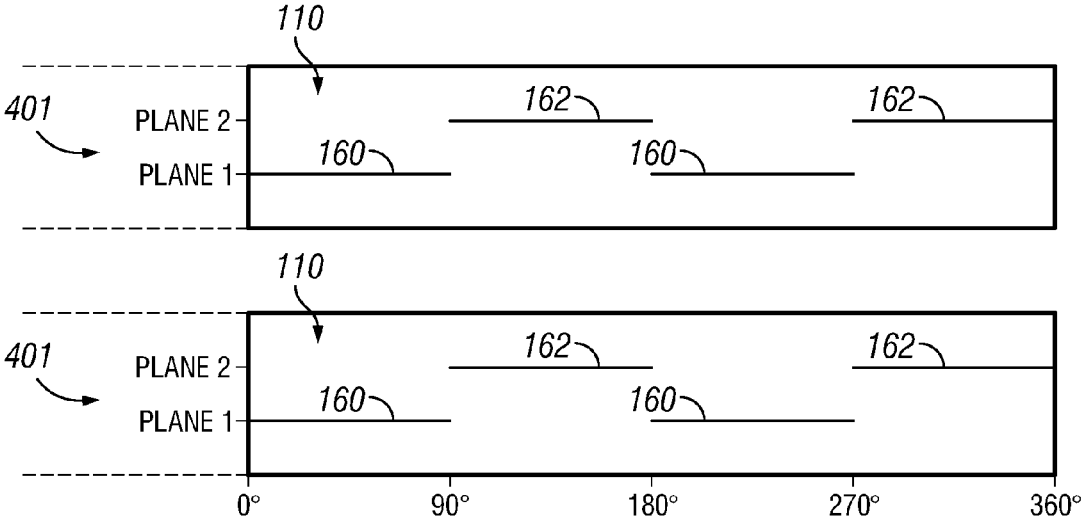
FIG. 7 is a schematic view of slots formed in a casing with an embodiment of a cutting tool.

In operation, the tool 100 will form a pattern of slots 101 in the casing as shown in FIG. 3 and the tool 400 will form a pattern of slots 401 in the casing as shown in FIG. 7. The tool 100 may be used advantageously to create horizontal slots through a plurality of casings, such as concentric casings 110 and 110*a*, or three (3) casings or the like, while forming slots 150, 152, 160, and 162 that may cover substantially a full 360° of the interior surface of the casing or casings 110 or 110*a* while not cutting or severing the casing 110 or 110*a* into distinct portions thereof.

After the slots 101 or 401 are formed, a fluid, such as a sealing fluid such as cement or the like may be flowed from suitable surface equipment, such as the surface equipment 118, through the conveyance or coiled tubing 104, through the slots 150 and 152 and into the space 112 in order to seal the space 112 between the casing 104 and the formation 114. Preferably, the tool 100 or 400 is withdrawn from the wellbore 102 prior to introduction of the cement or sealing fluid. The cement may comprise, but is not limited to, cement known by the commercial name of SqueezeCRETE and available from Schlumberger Corporation, or may comprise any suitable sealing fluid.

Figure 8:
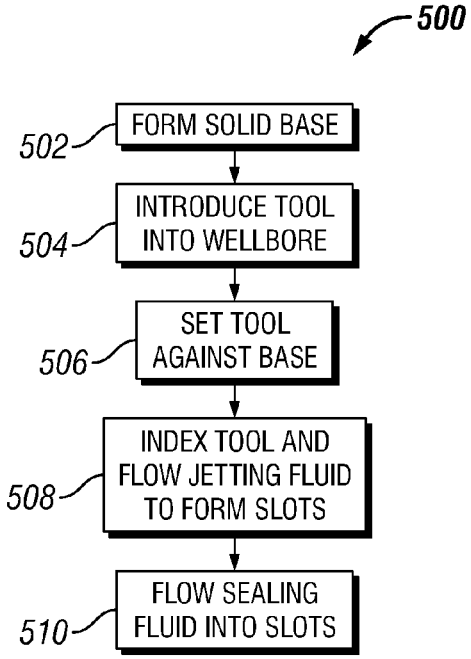
FIG. 8 is a flowchart depicting an embodiment of a method for forming slots in a wellbore casing.

Referring now to FIG. 8, in a method of operation, indicated generally at 500, a solid base 116, such as a bridge plug, a sand plug, a cement plug or the like, is formed in a step 502 by any suitable method. In a step 504, the tool 100 or 400 is introduced into the wellbore 102 on the conveyance 104. In a step 506, the tool 100 or 400 is set against the solid base 116. In a step 508, the tool 100 or 400 is indexed or rotated and abrasive or jetting fluid is flowed from the surface equipment 118 through the conveyance 104 and through the jets 124, 126 or the nozzles 425 to form slots 150, 152, 160, or 162. In a step 510, a sealing fluid is flowed from suitable surface equipment, such as the surface equipment 118, through the slots 150, 152, 160, and 162 to seal the space or annulus 112 between the casing 104 and the formation 114 and/or the area 113 between multiple strings of casing 110 and 110*a* and thereby plugging or killing the wellbore 102.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings. Instead, the scope of the application is to be defined by the appended claims, and equivalents thereof.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A method for forming slots in a wellbore casing, comprising:

providing at least one cutting tool, the cutting tool comprising at least a jetting assembly and an indexing assembly;

forming a solid base in the wellbore;

disposing the cutting tool into the wellbore via a conveyance;

stopping movement along the wellbore axis of the cutting tool by engaging the indexing assembly with the solid base thereby preventing axial movement of the cutting tool; and applying axial force to the conveyance thereby actuating the indexing assembly and causing rotation of the jetting tool via reciprocating actuation of the indexing assembly such that the jetting assembly forms slots in the casing.

2. The method of claim 1 further comprising flowing a material into the slots formed in the casing to seal the wellbore.

3. The method of claim 2 wherein the material comprises a cement material.

4. The method of claim 2 further comprising killing the wellbore by flowing the material into the casing and at least an annulus disposed around the casing.

5. The method of claim 1 wherein the solid base comprises at least one of a bridge plug, a sand plug, a cement plug, and combinations thereof.

6. The method of claim 1 wherein forming slots comprises forming slots in the casing without completely severing the casing into distinct portions thereof.

7. The method of claim 1 wherein the indexing assembly comprises an outer shell and an inner mandrel disposed interior of the outer shell, the outer shell having a pin that engages with a helical groove formed in the outer surface of the mandrel, the indexing assembly further comprising a spring-biased bushing in the outer shell for urging the shell in an upward direction, and wherein applying the axial force to the conveyance compresses the spring thereby allowing the outer shell to move downwardly while the mandrel remains substantially stationary, the pin engaging with the groove and rotating the jetting assembly and indexing assembly during movement thereof.

8. The method of claim 1 wherein providing comprises providing surface equipment having a supply of jetting fluid in fluid communication with the cutting tool.

9. The method of claim 1 wherein disposing comprises disposing the cutting tool into the wellbore via coiled tubing.

10. The method of claim 1 wherein forming comprises forming slots in the casing in a predetermined pattern that are substantially perpendicular to the wellbore axis of the cutting tool.

11. The method of claim 1 wherein forming comprises forming slots in multiple concentric casings.

12. The method of claim 1 wherein the jetting assembly comprises first and second nozzles and wherein forming comprises forming slots with the first nozzles, deactivating the first nozzles, activating the second nozzles and forming slots with the second nozzles.

13. A system for forming slots in a cased wellbore, comprising a conveyance for disposing the cutting tool in the wellbore;

at least one cutting tool, the cutting tool comprising at least a jetting assembly and an indexing assembly, wherein the indexing assembly comprises an outer shell and an inner mandrel disposed interior of the outer shell, the outer shell having a pin that engages with a helical groove formed in the outer surface of the mandrel, the indexing assembly further comprising a spring-biased bushing in the outer shell for urging the shell in an upward direction, wherein an application of an axial force to the conveyance compresses the spring, allowing the outer shell to move downwardly while the mandrel remains substantially stationary, the pin engaging with the groove and rotating the jetting assembly and indexing assembly during movement thereof; and surface equipment in fluid communication with the at least one cutting tool via the conveyance, the cutting tool configured to form a plurality of distinct slots in the casing of the wellbore when actuated.

14. The system of claim 13 wherein the conveyance comprises coiled tubing.

15. The system of claim 13 wherein the surface equipment comprises jetting fluid equipment.

16. The system of claim 13 wherein the cutting tool further comprises a base index assembly for engaging with a solid base within the wellbore and further comprising a bearing for allowing rotation of the jetting assembly and indexing assembly.

17. The system of claim 13 wherein the at least one cutting tool comprises at least a pair of nozzle bodies for forming the slots, the tool further comprising at least one centralizer disposed between the nozzle bodies, wherein the at least a pair of nozzle bodies are configured to be selectively deactivated.

* * * * *